United States Patent [19]

Linz

[11] Patent Number: 4,674,315

[45] Date of Patent: Jun. 23, 1987

[54] ADJUSTABLE CLAMPING ELEMENT FOR TOP TOOLS ON PRESSES

[75] Inventor: Paul Linz, Lübbecke, Fed. Rep. of Germany

[73] Assignee: Maschinenfabrik HILMA GmbH, Hilchenbach, Fed. Rep. of Germany

[21] Appl. No.: 798,254

[22] Filed: Nov. 14, 1985

[30] Foreign Application Priority Data

Mar. 6, 1985 [DE] Fed. Rep. of Germany ..... 3507912

[51] Int. Cl.[4] ..... B21D 37/14

[52] U.S. Cl. ..... 72/481; 100/918

[58] Field of Search ..... 72/481, 482; 83/678; 100/918; 269/60

[56] References Cited

U.S. PATENT DOCUMENTS 3,335,657 8/1967 Clements .

4,598,574 7/1986 Hegel et al. ..... 72/481

4,602,497 7/1986 Wallis ..... 72/481

OTHER PUBLICATIONS

Elech-Rohre-Profile 31, 10/1984, p. 409.

*Primary Examiner*—Lowell A. Larson

*Attorney, Agent, or Firm*—Martin A. Farber

[57] ABSTRACT

The displaceable clamping element for top tools on presses has a housing member with a T-shaped profiled head (6) which is held suspended in a T-slot (7) arranged horizontally on the underside of the press ram (2) and is displaceable in it, as well as clamping means (21, 22) for the top tool (1) and a fixed stop (20) for the top tool (1) for determining the position of clamping; the housing member is divided into a clamping-member base (4) having the T-shaped profiled head and a clamping-member head (5) having the clamping means (21, 22) and the fixed stop (20), the two of which engage in one another with a T-slot development (13) which is arranged inclined to the top tool (1) opposite the T-slot guide (7) in the ram (2), being movable with respect to each other, limited by stops (15, 16). The clamping-member head (5) in the clamping position engages against the underside of the press ram (2).

16 Claims, 4 Drawing Figures

ADJUSTABLE CLAMPING ELEMENT FOR TOP TOOLS ON PRESSES

FIELD AND BACKGROUND OF THE INVENTION

The invention relates to a displaceable clamping element.

In particular, the invention relates to an adjustable clamping element for top tools on presses, the housing member of which is held suspended with a T-shaped profiled head in a T-slot arranged horizontally on the underside of a press ram and displaceable in said slot, said element having clamping means for the top tool and contact members for the top tool for determining the clamping position.

The holding and guiding of movable clamping elements for tools and, in particular, workpieces, in T-slot guides in the holding part are very common. This system of clamping is used also in the case of tools which are to be clamped suspended from rams of presses, in particular also in the case of transfer presses. The clamping forces are exerted by hydraulically actuated clamping pistons or else mechanically, for instance by toggle levers. For the horizontal displacement of the clamping elements, several of which are generally used for the clamping of a tool, spindle drives having a motor-driven spindle which passes through a spindle nut in the clamping element are known, as well as chain drives or motion drives consisting of piston-cylinder units.

In the case of suspended clamping elements, play is present between the housing member of the clamping element and the press ram in unloaded condition, for instance also upon displacement for adaptation to different tool diameters and corresponding adjustment to new clamping positions for the clamping element, which play results from the guidance play necessary for the displacement movement and the tolerances of the T-slot guide and becomes visible due to the weight of the clamping element. This play, without which displacement of the clamping element is not possible, leads, under load by the clamping forces of the clamping elements, to a sudden canting of the housing member with respect to the press ram in the clamping position. This canting during the clamping takes place suddenly with very great force, so that damage can frequently be observed due to the partially increased pressure per unit of surface between the housing member of the clamping element and the press ram, particularly if the displacement drive used requires smoothly machined slide surfaces in the T-slot guide as well as on the profiled head of the housing member and also in the T-slot of the press ram.

SUMMARY OF THE INVENTION

It is an object of the invention to avoid the sudden canting of clamping elements arranged suspended on press rams caused by the clamping forces upon clamping under high load, and the damage resulting therefrom.

According to the invention, the housing member is divided into a clamping-member base (4) having a T-shaped profiled head (6) and a clamping-member head (5) having the clamping means (21, 22) and the contact members (20), the clamping-member base and head engaging into each other via a T-slot (13) which is inclined towards the top tool (1) with respect to the said T-slot guide (6, 7) in the ram (2) and being movable relative to each other, limited by stops (15, 16), the clamping-member head (5) having support surfaces which engage in the clamping position against the press ram (2).

These construction features have the result that the play between the suspended clamping element and the surface of the press ram at the end of the adjustment operation for the clamping element is traversed by a relatively slight relative movement between the clamping-member base guided in the T-slot guide of the press ram and the clamping-member head which carries the clamping means, and that the clamping-member head is locked against the press-ram surface. This result is obtained by the oblique formation of the T-slot between the two parts of the housing member, from which, due to the relative movement, a transverse movement of the clamping-member head occurs in the direction towards the underside of the press ram, so that the support surfaces of the clamping-member head engage without play against the underside of the press ram. The clamping means for the tool can then be activated and do not produce a sudden canting of the clamping element in the T-slot guide or on the surface of the press ram. The angle of the inclined position of the T-slot formation between the clamping-member base and the clamping-member head can be so selected in this case that no self-locking for the relative movement occurs. On the other hand, this relative movement is required only to such a small extent that the transverse component of the movement, resulting from the oblique wedge formation, compensates for the play between the clamping-member head and the press-ram surface. In this connection, by the inclined formation the clamping-member head is lifted towards the press-ram surface and wedged. According to the invention, the movability of the clamping-member base (4) with respect to the clamping-member head (5) is limited to the transverse movement, resulting from the inclination of the T-slot (13) between the head and base, corresponding to the play necessary for the displacement of the clamping-member base (4) in the T-slot guide (7) within the press ram (2).

For limiting the relative movement, in accordance with a further development of the invention, the clamping-member base (4) engages with slight play from above into a recess (14) in the clamping-member head, the dimension of said recess in the plane of the direction of displacement being slightly greater than the length of the clamping-member base (4) in this same direction and its end surfaces forming fixed stops for limiting movement of the clamping-member base and the clamping-member head relative to each other.

Further, according to the invention, the angle of the inclined formation of the T-slot formation (13) between the clamping-member base (4) and the clamping-member head (5) is larger than the angle for self-locking.

Furthermore, between the clamping-member base (4) and the clamping-member head (5) there is arranged a spring (17) which urges the clamping member head in the direction towards the top tool (1).

Another feature of the invention which is of particular importance is the development of the contact member (20) on the clamping-member head (5) for the position of the top tool (1), as a fixed but preferably adjustable stop for initiating the relative movement. This permits a simple, robust construction for the intended relative movement between the clamping-member head and the clamping-member base at the end of the adjustment operation. The fixed stop then comes against a counter surface on the top tool and prevents the clamping-member head from moving further in the direction of adjustment, so that with the displacement drive still operating the clamping-member base is moved still further by a small amount, counter to the spring between both the head and base, relative to the clamping-member head until the drive is disconnected or a hydraulic drive overflows. With the use of a fixed stop for the clamping-member head against the top tool, a hydraulic drive with an overflow valve is particularly suitable for the displacement spindle. Upon a new adjustment operation, the spring reestablishes the starting position.

The spring advantageously comprises a mass of elastomeric material which is arranged on a pin guide in a bore surrounding it so that the spring force progressively increases upon the relative movement between the clamping-member base and clamping-member head and thus can act as a damping member in order to permit the locking of the clamping-member head with the press ram to take place as gently as possible.

Thus according to the invention the spring (17) which acts between the clamping-member base (4) and the clamping-member head (5) is formed as a bumper of elastomeric material such as rubber, for example.

Further, the bumper (17) is arranged, in part, in the bore (19) which surrounds it with play and is guided on a pin (18).

A further feature of the invention is that the end surfaces which form the fixed stop surfaces (15, 16) for the movement of the clamping-member base (4) in the recess (14) of the clamping-member head (5) are formed by removable parts.

Still further according to the invention, the clamping element is displaceable within the press ram (2) by means of a spindle (8) which passes through a spindle nut (12) arranged in the spindle-member base (4).

According to still another feature, hydraulically actuated clamping pistons (21, 22) are arranged in the clamping-member head (5) and act against a clamping flange on the top tool (1).

The new development is also advantageous with respect to the use of spindle drives for the displacement of the clamping element.

The development according to the invention in combination with the hydraulically actuated clamping means (21, 22) and correspondingly large clamping forces is of particular advantage if said forces are suddenly applied and clamp the tool. Blows by canting of the clamping elements and the disadvantageous results of the prior art produced thereby are avoided by the development of the clamping element in accordance with the invention.

BRIEF DESCRIPTION OF THE DRAWINGS

With the above and other objects and advantages in view, the present invention will become more clearly understood in connection with the detailed description of a preferred embodiment, when considered with the accompanying drawings, of which.

DETAILED DESCRIPTION OF THE PREFERRED EMBODIMENT

Figures 1, 2, 3:
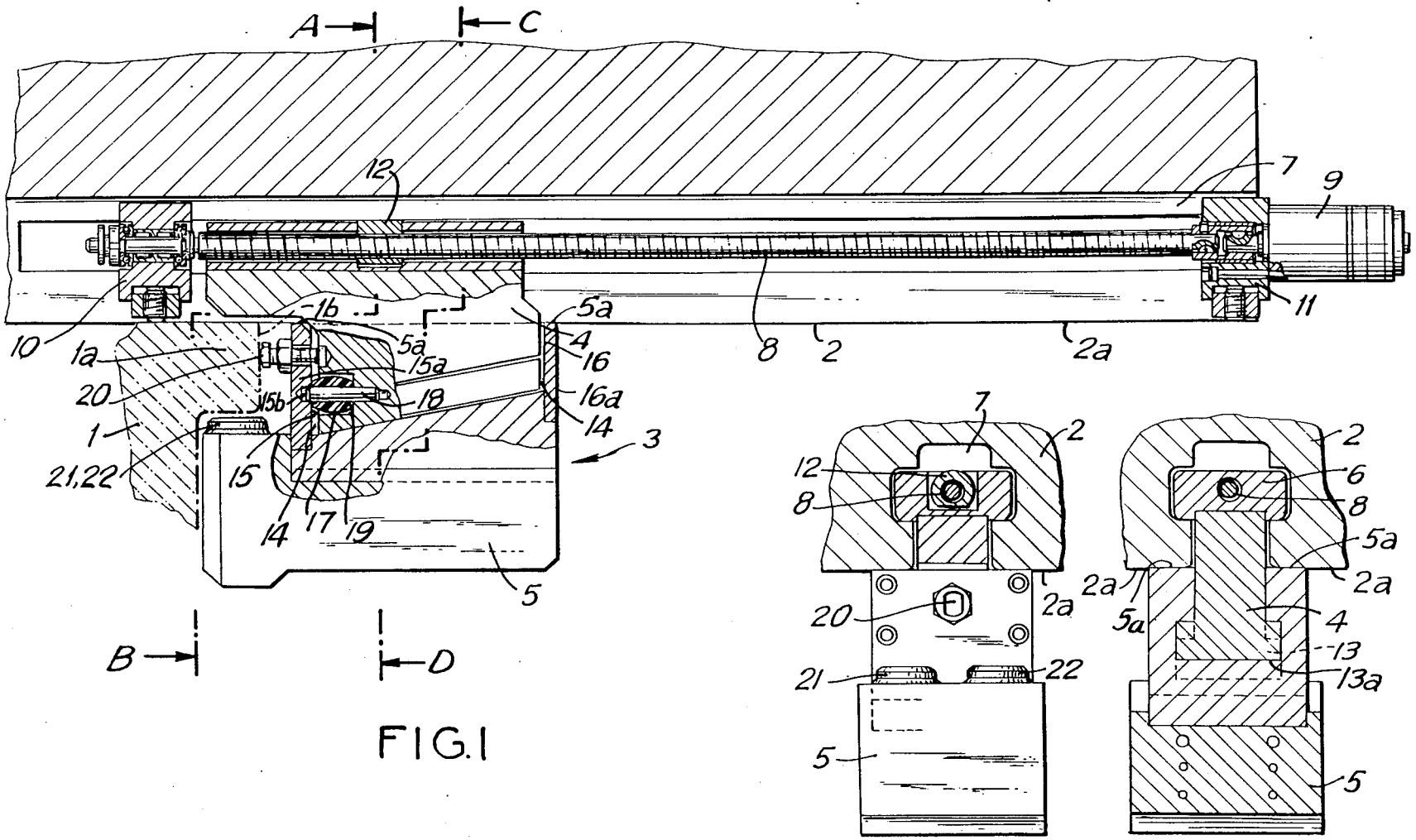
FIG. 1 shows a clamping element with spindle displacement, seen partially in side view and partially in section parallel to said side view.
FIG. 2 is a section along the line A-B of FIG. 1
FIG. 3 is a section along the line C-D of FIG. 1.

For the fastening of a top tool 1 to the underside 2*a* of a press ram 2, clamping elements 3 are provided (one being shown). The housing member of this clamping element is divided and comprises a clamping base 4 which is located on top and a relatively displaceable clamping member head 5 which is located on the underside. The clamping-member base 4 engages by means of a T-shaped profiled head 6 into a T-slot formation 7 of prismatic cross section in the press ram 2. The profiled head 6 of the clamping-member base 4 is displaceable for horizontal movement within said T-slot 7. For this displacement, a drive is provided comprising a threaded spindle 8 having a hydraulically actuated drive motor 9, its spindle being supported by bearings 10 and 11 in the press ram 2, passing through a spindle nut 12 which is arranged non-rotatably in the clamping-member base 4 so that, by the turning of the threaded spindle, displacemnt of the clamping element in both directions is possible.

The clamping-member base 4 and the clamping-member head 5 engage, in a manner similar to the T-slot guide 7, also in each other via a T-slot formation which, however, is arranged inclined in the direction towards the top tool 1. In the region of this T-slot formation the clamping-member base 4 is developed with a widened profiled head 13 of prismatic cross section which engages into a corresponding T-slot 13*a* forming a guide with inclined surfaces in the clamping-member head 5, as can be noted more clearly from FIG. 3. The clamping-member head 5 is thereby suspended with its inclined surfaces on correspondingly inclined supporting surfaces on the top of the prismatic profiled head 13 of the clamping-member base 4. This formation is arranged, as shown in FIG. 1, within a recess 14 in the clamping-member head 5 into which recess the clamping-member base 4 engages. The dimension of the recess 14 in the plane of the direction of displacement is, however, slightly greater than the same dimension of the clamping-member base, end surfaces 15 and 16 of the recess representing stop surfaces for the relative movement of the clamping-member head 5 with respect to the clamping-member base 4. For purposes of assembly, these stop surfaces 15 and 16 are surfaces of removable plates 15*a*, 16*a* or parts removably connected to and thus forming part of the clamping-member head 5.

Furthermore, the clamping-member head 5 is biased by a spring 17 with respect to the clamping-member base 4, which spring urges the clamping-member head 5 in the direction towards the top tool 1. This spring may advantageously be formed as a compressible spring cushion or bumper 17 made of an elastomeric material e.g., rubber which is arranged on a pin guide 18 within a bore 19. The pin guide 18 is secured to the base 4, passes through the bore 19 and extends relatively displaceably into a bore 15*b* in the plate 15*a* on the clamping-member head 5. The wall of the bore 19 surrounds the bumper 17 with clearance so that the bumper 17, upon compression, can initially expand freely, radially to the direction of the axis of the pin 18 before it comes against the wall of the bore 19 so as to build up progressively increasing spring forces which act as a shock absorber.

On the plate 15*a* of the clamping-member head 5 on the front side of the housing member facing the top tool 1 there is arranged a fixed but adjustable stop 20 which consists, for instance, of a set screw with lock nut.

As clamping means for the top tool 1 two adjacent hydraulic clamping pistons 21 and 22 are arranged alongside of each other in the example shown, engagable, in the clamping position, from underneath a clamping edge or flange 1*a* of the top tool 1 and pressing it firmly against the underside 2*a* of the press ram 2. The top tool 1 for example can be a die.

For clamping the top tool 1, the clamping element 3 is moved forward horizontally from the right to the left in the plane of the drawing towards the top tool 1 by means of the spindle drive 8–12 until the stop 20 comes against the right-side mating surface 1*b* on the top tool 1 as shown in FIG. 1. In this position, further leftward displacement movement of the clamping-member head 5 is no longer possible. With the spindle displacement drive still operating however, the clamping-member base 4 is carried along further to the left for a short distance corresponding to the play within the recess 14, in which connection the bumper 14 compresses and gradually builds up spring force. As a result of the wedge-shaped arrangement of the T-slot formation 13*a* between the clamping-member base 4 and the clamping-member head 5 there is a component force upward, effecting movement of the latter transverse to the horizontal direction of displacement, whereby the clamping-member head 5 which can no longer move to the left is lifted and pressed with support surfaces 5*a* thereof firmly against the underside 2*a* of the press ram 2, as can be noted from FIG. 3 and the bumper 17 becomes compressed.

In this way there is established a firm locking of the clamping-member head 5 by means of the press ram surface 2*a* so that the hydraulically actuated clamping pistons 21 and 22 can be released, lifting in order to clamp the top tool 1. When a hydraulic motor 9 is used for driving the spindle 8, the displacement drive can continue in operation until the complete clamping of the head 5 to the press ram 2.

For releasing the tool 1 the clamping pistons 21 and 22 are, first of all, moved back, whereupon then the clamping-member base 4 is moved by the spindle drive 8, 12 to the right, away from the top tool 1, the clamping-member base 4 resting then against the plate 16*a*, the guidance clearance necessary for the displacement movement being thereby restored between the surfaces 5*a* and 2*a* of the clamping-member head 5 and the press ram 2 respectively. Upon further displacement movement, the clamping-member base 4 and the clamping-member head 5 then jointly move further to the right.

Figure 4:
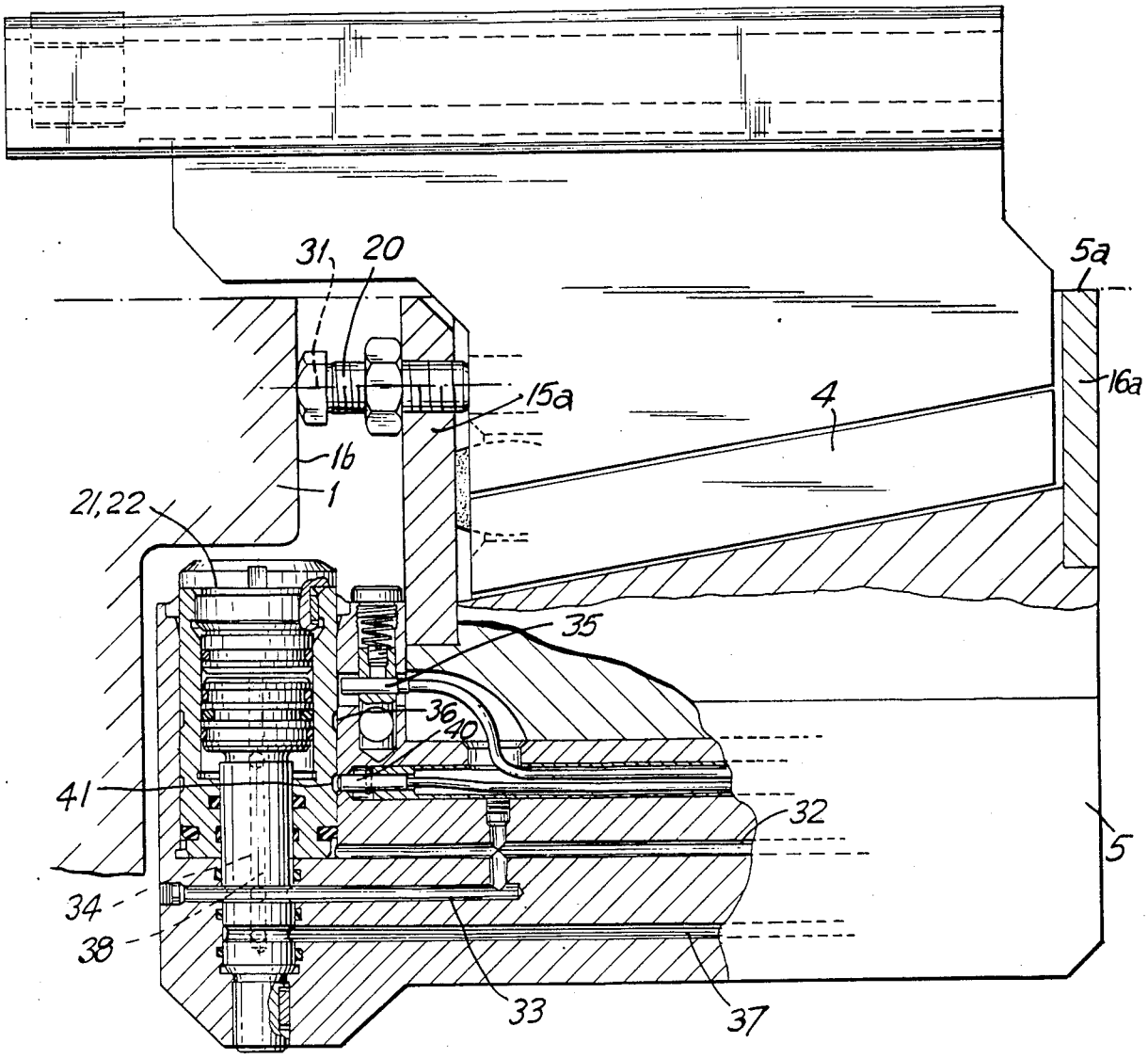
FIG. 4 is an enlarged section corresponding to FIG. 1 showing the hydraulic circuit and proximity switches for the clamping element.

In further detail referring to FIG. 4, during the beginning of a clamping operation, when the clamping element 3 and particularly the clamping member head 5 abuts the die tool 1 by means of the stop 20, a proximity switch 31 signals the hydraulic oil motor 9 to shut off after a time delay. The time delay is short and during this time the base 4 is moved further to the left by the motor 9 as discussed above, and the clamping member head 5 lifts to clamp against the underside 2*a* of the press ram 2. The drive motor 9 at this time shuts off by expiration of the time delay and the members 4 and 5 are held fixed in this condition. After the drive motor 9 has stopped the pistons 21,22 are now automatically activated, by oil pressure in line 32 and branch lines 33 through a central bore 34 in the pistons acting on two surfaces of each piston 21, 22 providing a double action and lifting with high clamping force. The pistons 21, 22 rise and clamp the flange 1*a* of the die tool 1. A proximity switch 35, which is preferably a magnetic field detector, for example, detects a slot 36 formed on a piston 21 or 22, when the piston has been raised to the proper clamping level which clamps the standard thickness flange 1*a* of the die top tool 1. When this occurs a signal is sent via the proximity switch 35 to the hydraulic system to maintain the existing condition.

When unclamping, which is performed by pressurizing line 37 transmitting hydraulic fluid via another central bore 38 in the pistons to another surface of the pistons 21, 22 to retract the pistons, hydraulic fluid in the lines 32, 33 is returned to an oil reservoir (not shown). Proximity switches 40 detect the unclamping position of the pistons via a groove or slot 41 on the pistons and signal activation of the motor 9, now in reverse, to move the clamping element 3 the reverse as described above to the right.

In accordance with the arrangement of the present invention, when the clamping member head 5 is clamped against the underside 2*a* of the press ram 2, the entire clamping element 3 is held without making marks or scratches on the ram.

During the relative movement of the base 4 with respect to the clamping member head 5 during the end portion of the clamping operation, the rubber spring 10 compresses. During the release of this clamping the spring 10 unstresses urging the base 4 to the right and causing the clamping member head 5 to lower.

I claim:

1. In an adjustable clamp for a replaceable top tool on a press ram, the clamp comprising a housing member having a T-shaped head, the clamp being suspended by the head displaceably disposed in a T-slot horizontally arranged at an underside of the press ram, the clamp further comprising clamping means for clamping the top tool and at least one contact member cooperating with the top tool for determining the position for clamping the clamp, the improvement in the clamp wherein said housing member comprises a base having said T-shaped head and a clamping member head having said clamping means and said contact member, said base and said clamping member head cooperatively form a T-slot guide which is inclined towards the top tool and with respect to said T-slot in the press ram, said base and said clamping member head via said T-slot guide interengage and are relatively movable with respect to each other, said housing member includes stops which limit relative movement of said base and said clamping member head with respect to each other, and said clamping member head having support surfaces which abut the underside of said press ram in the position for clamping.

2. The adjustable clamp according to claim 1, wherein said clamping member head is formed with a recess, said base is disposed from above into said recess in said clamping member head with a little play, said recess, in a direction of said relative movement of said base and said head with respect to each other parallel to said T-slot, being slightly greater then the length of the base in the same direction, and said stops define end surfaces of said recess forming fixed stops for limiting said relative movement of said base and said clamping member head with respect to each other in said direction parallel to said T-slot.

3. The adjustable clamp according to claim 2, wherein said end surfaces, which form said fixed stops, limit the relative movement parallel to said T-slot of said base in said recess of said clamping member head with respect to latter, and are formed by parts removably connected to said clamping member head.

4. The adjustable clamp according to claim 1, wherein said T-slot guide has an angle of inclination with respect to the horizontal larger than an angle self-locking the relative movement of said base and said clamping member head with respect to each other.

5. The adjustable clamp according to claim 1, further comprising means for displacing said base horizontally along said T-slot, said base and said clamping member head via said T-slot guide interengage such that the relative movement of said base and said clamping member head by means of the inclination of said T-slot guide comprises a first relative movement of said base and said clamping member head in said direction parallel to said T-slot and a second relative movement in a direction transverse to said direction parallel to said T-slot toward and away respectively from said press ram, said relative movement in said transverse direction being limited corresponding to play for the displacement of said base in said T-slot within the press ram.

6. The adjustable clamp according to claim 1, wherein said contact member is fixed on said clamping member head for determining the position for clamping of said clamping member head and comprises an adjustable stop.

7. The adjustable clamp according to claim 1, further comprising spring means between said base and said clamping member head for biasing said clamping member head towards the top tool.

8. The adjustable clamp according to claim 7, wherein said spring means comprises a bumper made of elastomeric material.

9. The adjustable clamp according to claim 8, wherein one of said base and said clamping member head is formed with a bore and includes a pin extending into said bore, said bumper is disposed guidably on said pin in said bore with play in an unclamped position of said housing member.

10. The adjustable clamp according to claim 1, further comprising a spindle rotatably mounted in said press ram, a spindle nut threaded on said spindle and arranged in said base, and means for rotating said spindle.

11. The adjustable clamp according to claim 10, wherein said spindle extends through said T-shaped head of said base, and said spindle nut is non-rotatably mounted in said T-shaped head of said base.

12. The adjustable clamp according to claim 1, wherein said clamping means comprises hydraulic clamping pistons arranged in said clamping member head and operatively clampable against a clamping edge of the top tool.

13. The adjustable clamp according to claim 12, wherein said clamping means is arranged in said clamping member head laterally spaced from said contact member.

14. A clamp for clamping a top tool to a press ram by a clamping means mounted in a housing member on the press ram, comprising first means for moving the housing member on the press ram sideways adjacent to the top tool, second means for moving the housing member toward said press ram until said housing member is clamped against an underside of said press ram, means for thereafter moving said clamping means toward said top tool until said clamping means clamps said top tool against said underside of said press ram, said housing member comprises a base movable sideways on said press ram and a head mounted on said base, said base is moved sideways to the press ram by said first means for moving the housing member on the press ram sideways adjacent to the top tool, said head is mounted on said base such that said base carries said head to a position sideways against said top tool as said base is moved adjacent to said top tool, said first means further for moving said base further sideways toward said top tool and with respect to said head while said head remains against said top tool stationary in a sideways direction with respect to said top tool and cooperating with said second means for raising said head toward said press ram until said head of said housing member is clamped against the underside of said press ram.

15. The clamp according to claim 14, wherein said second means is a slot guide inclined with respect to said sideways direction and to a direction transverse to said sideways direction.

16. The clamp according to claim 15, further comprising a cushion disposed between said base and said head.

* * * * *